US006159335A

United States Patent [19]

Owens et al.

[11] Patent Number: 6,159,335

[45] Date of Patent: Dec. 12, 2000

[54] METHOD FOR TREATING PULP TO REDUCE DISINTEGRATION ENERGY

[75] Inventors: James William Owens, Cincinnati, Ohio; John P. Erspamer, Bartlett; Charles Edward Bost, Germantown, both of Tenn.; John J. Ryan, deceased, late of Memphis, Tenn., by Ruth Ryan, executrix

[73] Assignee: Buckeye Technologies Inc., Memphis, Tenn.

[21] Appl. No.: 09/027,061

[22] Filed: Feb. 20, 1998

[51] Int. Cl.[7] ..... D21C 9/00

[52] U.S. Cl. ..... 162/9; 162/100; 162/158; 162/181.1; 162/181.2; 162/181.3; 162/181.4; 162/181.5; 162/181.6; 162/181.7; 162/181.8

[58] Field of Search ..... 162/100, 158, 162/182, 9, 181.1, 181.2, 181.3, 181.4, 181.5, 181.6, 181.7, 181.8

[56] References Cited

U.S. PATENT DOCUMENTS

| | | | |
|---|---|---|---|
| 1,634,603 | 7/1927 | Wood . | |
| 1,746,451 | 2/1930 | Wells . | |
| 2,001,246 | 5/1935 | Gephart . | |
| 3,013,932 | 12/1961 | Hinrichs et al. . | |
| 3,015,602 | 1/1962 | Taylor . | |
| 3,023,140 | 2/1962 | Textor . | |
| 3,463,699 | 8/1969 | Broadhead et al. . | |
| 3,559,649 | 2/1971 | Grad et al. . | |
| 3,615,795 | 10/1971 | Schulwitz et al. . | |
| 3,627,629 | 12/1971 | Miller . | |
| 3,630,830 | 12/1971 | Hardle et al. . | |
| 3,640,842 | 2/1972 | Hullinger et al. . | |
| 3,677,886 | 7/1972 | Forssblad et al. | 162/182 |
| 3,693,622 | 9/1972 | Jones, Sr. . | |
| 3,929,558 | 12/1975 | Shaw . | |
| 3,935,363 | 1/1976 | Burkholder et al. . | |
| 4,015,604 | 4/1977 | Csillag . | |
| 4,045,279 | 8/1977 | Nagano et al. . | |
| 4,229,250 | 10/1980 | Lehtinen . | |
| 4,303,471 | 12/1981 | Laursen | 162/158 |
| 4,388,148 | 6/1983 | Yahrmarkt et al. . | |
| 4,584,357 | 4/1986 | Harding . | |
| 4,718,980 | 1/1988 | Lowrie et al. . | |
| 4,737,238 | 4/1988 | de Ruvo . | |
| 4,767,499 | 8/1988 | Simonson et al. . | |
| 4,888,238 | 12/1989 | Katz et al. . | |
| 4,941,943 | 7/1990 | Edelman et al. . | |
| 5,007,985 | 4/1991 | Engstrand et al. . | |
| 5,138,002 | 8/1992 | Bjorkquist . | |
| 5,171,309 | 12/1992 | Gallagher et al. . | |
| 5,171,391 | 12/1992 | Chmielewski et al. . | |
| 5,221,435 | 6/1993 | Smith, Jr. . | |
| 5,225,041 | 7/1993 | Richard et al. . | |
| 5,225,047 | 7/1993 | Graef et al. . | |
| 5,248,309 | 9/1993 | Serbiak et al. . | |
| 5,275,699 | 1/1994 | Allan et al. . | |
| 5,314,583 | 5/1994 | Kappel . | |
| 5,331,087 | 7/1994 | Menges . | |
| 5,338,405 | 8/1994 | Patt et al. . | |
| 5,399,240 | 3/1995 | Graef et al. . | |
| 5,466,337 | 11/1995 | Darlington et al. . | |
| 5,466,513 | 11/1995 | Wanek et al. . | |
| 5,512,135 | 4/1996 | Carré et al. . | |
| 5,601,921 | 2/1997 | Eriksson . | |

FOREIGN PATENT DOCUMENTS

| | | |
|---|---|---|
| WO 98/17856 | 4/1998 | WIPO . |

OTHER PUBLICATIONS

Susan Nicole Lloyd et al., "Absorbent Structures Having Thermally Bonded Resilient Web for Improved Fit and Comfort", United States Statutory Invention Registration No. H1698, published Nov. 4, 1997, 19 pages.

James P. Hanson, Breathable Absorbent Disposables–Market Developments and The Future, Nonwovens World, Nov. 1986, pp. 102–104 and 107–108.

James P. Hanson, Designing Better Superabsorbent Baby Diapers, Nonwovens World, May–Jun. 1987, pp. 69–74.

Jeanne K. Carroll, U.S. Market Outlook for Consumer Absorbent Products, Nonwovens World, Sep. 1998, pp. 51–53.

*Primary Examiner*—Peter Chin
*Attorney, Agent, or Firm*—Darby & Darby

[57] ABSTRACT

A method of reducing the amount of energy required to disintegrate comminution sheets formed from cellulose fibers without adversely affecting the absorbency, strength, or fluid transport properties of airfelts formed from the comminuted treated fibers. The method of the present invention includes the steps of preparing an aqueous slurry of cellulose fibers, adding an effective amount of a debonding agent such as aluminum or Kaolin clay to the cellulose slurry, and forming a comminution sheet from the fibers treated with the debonding agent. The debonding agent is added to the cellulose slurry in an amount effective to reduce the energy required to disintegrate comminution sheets formed from the fibers in the slurry by up to 50% of the amount of energy required to disintegrate comminution sheets formed from untreated pulp.

8 Claims, No Drawings

METHOD FOR TREATING PULP TO REDUCE DISINTEGRATION ENERGY

FIELD OF THE INVENTION

The present invention relates to a method for treating cellulose fibers to reduce the amount of energy required to disintegrate a sheet formed from the cellulose fibers.

BACKGROUND OF THE INVENTION

Due to high absorption capacity and lower costs, natural cellulose fibers are preferred components of many disposable absorbent products, such as diapers, catamenials, and adult incontinence products. The cellulose fibers are provided to manufacturers of disposable absorbent products in the form of fibrous comminution pulp sheets or rolls which are manufactured by conventional wet-laid techniques. Generally, disposable absorbent products are manufactured in a continuous manufacturing process. The disposable product manufacturer typically disintegrates or comminutes the pulp sheets with a hammer mill or similar mechanical apparatus to separate the cellulose fibers into a fluff commonly known as airfelt. Chemically softened pulp is most commonly used in place of untreated pulp, because it is easier to disintegrate on a hammer mill or similar disintegration equipment. Moreover, the use of softened pulp is required on some low powered equipment, such as pin cylinders. The comminution pulp is formed into nonwoven structures known as airfelt pads or airfelts using conventional airlaid techniques, and the airfelt pads are combined with other components to produce the final absorbent product such as a disposable diaper or feminine napkin. The airfelt pads must possess certain characteristics such as a high absorption capacity, strength and integrity, an adequate wicking rate, and other fluid transport properties in order to be suitable for use in disposable absorbent products.

Since the fiber sheets are disintegrated on-line in the diaper manufacturing process, the rate of production of the diapers or other disposable absorbent products is limited by the speed at which the fiber sheets can be disintegrated. Increasing the speed of disintegration requires significantly greater expenditure of energy or capital for larger disintegrated motors and related equipment.

Prior to the present invention, it was known that the amount of energy required to disintegrate pulp sheets could be reduced by adding surfactants to the cellulose fiber pulp. However, the surfactants typically used for this purpose create a hydrophobic, non-wetting surface on the pulp which results in the loss of many of the desired fluid transport properties in airfelts formed from surfactant treated fibers. Further, the surfactants act as a lubricant on the fibers and reduce the fiber to fiber friction required to form an airfelt with strength and integrity.

Therefore, there continues to be a need for natural cellulose fiber pulp for forming pulp sheets which do not require high amounts of disintegration energy and provide well-dispersed airfelt pads which retain the highly desirable characteristics of exceptional strength, absorbency, wicking rate, and other significant fluid transport properties found in untreated cellulose fibers.

SUMMARY OF THE INVENTION

Surprisingly, applicants have discovered that treating cellulose fiber pulp with a solution containing a debonding agent such as alum, Kaolin clay, calcium carbonate, titanium dioxide, zinc oxide or similar agents, prior to forming the pulp into sheets results in pulp sheets which require significantly less energy to disintegrate than pulp sheets formed from comminution pulp which has not been treated with a debonding agent. Applicants further discovered that the debonding treatment of the present invention has no adverse affect on the absorbency, strength, or fluid transport properties of airfelts formed from the comminuted treated pulp. Although not fully understood at this time, the mechanism of the debonding agent appears to be the formation of a precipitate on the surface of the pulp fibers which reduces the fiber to fiber bonding within the pulp sheet or roll. As a result, the pulp sheets formed from debonded treated pulp fibers require significantly less energy to disintegrate or comminute.

In a preferred method of the present invention, an aqueous slurry of cellulosic pulp fibers is prepared by conventional techniques. A solution containing a debonding agent then is added to the pulp slurry prior to formation of a pulp sheet or roll. The pH of the pulp slurry is adjusted, if necessary, to form a precipitate which coats the pulp fibers in the slurry. The debonded fibers then are formed into comminution sheets or rolls by conventional techniques.

Comminution sheets formed from the alum treated cellulose fibers treated with a debonding agent require significantly less energy to disintegrate than untreated cellulose fiber sheets. Depending upon the type and amount of debonding agent deposited on the fibers prior to sheeting, the disintegration energy can be reduced by up to 50% or more without any significant change in the properties of the airfelts produced from the disintegrated pulp. Typically, the disintegration energy used in the comminution process is reduced by at least 15% with the method of the present invention.

DETAILED DESCRIPTION OF THE INVENTION

In a preferred embodiment, the method of the present invention comprises forming an aqueous slurry of natural cellulosic pulp fibers. A solution containing a debonding agent, such as aluminum, is added to the pulp slurry and the pH of the slurry is adjusted to between about 4.0 and 8.0. The alum in the solution reacts to form an aluminum precipitate which coats the pulp fibers in the slurry. The coating significantly reduces the fiber to fiber bonding which occurs when the pulp fibers are formed into comminution pulp sheets or rolls. Since the fibers are not as highly bonded, the amount of energy required to disintegrate or comminute the sheets or rolls formed from the treated pulp fibers is substantially reduced. The airfelts formed from the comminution pulp after disintegration of the sheets have the exceptional absorption, strength, and fluid transport properties which are characteristic of airfelts formed from untreated cellulose comminution pulp.

The natural cellulose fibers used to form the comminution pulp sheets may be cotton linters, CTMP, northern or southern softwood fibers or hardwood blends. Chemically pulped wood fibers are especially preferred for use in the method of the present invention. In a particularly preferred embodiment, the cellulose fibers are chemically pulped southern softwood fibers sold by Buckeye Cellulose Corporation, 1001 Tillman Street, Memphis, Tenn. 38108, under the tradename FOLEY FLUFF.

Prior to undergoing the debonding treatment of the present invention, the pulp may be processed by any conventional pulping process, such as kraft, sulfite, semichemical, or mechanical. Preferably, the pulp is processed by the kraft or "sulfate" method prior to the alum treatment of the present invention. The pulp stock then is stored at a desired consistency under conventional conditions until being subjected to the present debonding treatment method.

Insoluble aluminum salts are particularly preferred as the source of aluminum used in the method of the present invention. The aluminum precipitate which is deposited on the pulp fibers provides a hydrophilic surface which retains or enhances the surface properties of the fibers. The insoluble aluminum salt used in the present method is preferably aluminum sulfate or alum. However, any source for the aluminum may be used which provides a suitable aluminum containing precipitate for deposition on the pulp fibers. Other suitable debonding agents include Kaolin clay, calcium carbonate, titanium dioxide, zinc oxide, or any material which can be used to coat the fibers without adversely affecting the hydrophylic properties of the fibers.

The amount of the debonding agent which is deposited on the pulp fibers by the present method is directly related to the initial consistency of the pulp in the pulp slurry. The amount of debonding agent which is deposited may also be related to the pH and concentration of the debonding agent/pulp slurry mixture, depending upon which debonding agent is selected. In a preferred embodiment of the method of the present invention, the pulp fibers are dispersed in a slurry at between about 1.0% and about 5.0% consistency. The debonding agent is added in an amount effective to reduce the amount of energy required to disintegrate a comminution sheet or roll formed from the debonded fibers without adversely affecting the hydrophylic properties of the fibers.

When alum is used as the debonding agent, preferably a solution containing between about 4.0% and about 5.0% alum then is added to the pulp slurry. The amount of aluminum deposited on the pulp fibers is preferably between about 5 and about 15 pounds per ton of pulp fibers. Typically, the optimum pH range required to deposit an effective amount of aluminum to the cellulose fibers is between about 4.0 and about 8.0. In a particularly preferred embodiment, the pH is adjusted to between about 5.0 and about 5.5.

The debonding agent preferably is added to the pulp after completion of the pulping and bleaching processes but before the pulp is formed into sheets or rolls, for example at any point from the storage chests to the paper machine dryers. The debonding agent added to the pulp slurry has no significant effect on the drainage and drying of the pulp sheets so that energy costs for producing the pulp sheets remain comparable to untreated pulp.

The pulp fibers are allowed to remain in the suspension containing a debonding agent for a length of time sufficient to deposit an effective amount of debonding agent on the fibers. For example, it has been found that the optimum level of aluminum precipitate for an acceptable reduction in disintegration energy is between about 2500 and about 6000 ppm, and preferably between about 3000 and about 6000 ppm. The amount of time the pulp fibers are allowed to stand in the alum solution can be as brief as about 2–10 seconds to deposit a sufficient amount of the aluminum precipitate on the fibers.

After the pulp fibers are coated with the debonding agent, the treated pulp fibers are formed into comminution sheets or rolls in a conventional manner for use in subsequent comminution processes. While the method of the present invention is described with reference to the end use of the comminution pulp in disposable absorbent products, it is to be understood that the debonded comminution pulp of the present invention is suitable for use in any other product or method which utilizes the comminution pulp.

Comminution pulp sheets typically are disintegrated using a hammer mill which breaks the fibers apart to form the pulp fluff or airfelt. The hammer mill may be used with or without a screen when Kaolin clay is used as the debonding agent, preferably for sizing the comminuted pulp. However, the amount of energy required by any mechanism or equipment for comminuting pulp sheets into comminution pulp is reduced by using the treated debonded pulp of the present invention. Experimental testing indicates that the amount of energy required to disintegrate the pulp sheets into comminution pulp can be reduced by at least between about 15% and about 50% from the amount of energy required to disintegrate pulp sheets formed from untreated pulp.

In order to demonstrate the disintegration efficiency comminution pulp sheets formed from the debonded fibers of the present invention, the disintegration energy for both treated and untreated pulp fibers was measured. In order to demonstrate that the airfelts formed from the debonded fibers of the present invention retain the absorbent capacity, strength, and fluid transport properties of untreated fibers, comparative tests were conducted which measure the absorbent capacity, strength, and fluid transport properties of airfelts formed from treated and untreated fibers.

Procedure for Measuring Disintegration Energy

Two comminution pulp sheets were formed by conventional wet laying techniques at the Buckeye Cellulose Corporation. The first pulp sheet was formed from cellulose fibers treated with a debonding agent according to the method of the present invention. The second pulp sheet was formed from standard untreated cellulose fibers. Both the treated and the untreated dry, machine sheet pulp was cut into 2"×20" strips, with the 30" dimension in the machine direction. The basis weight, thickness, and density of each strip was determined by the procedures described below and the weight of each strip was recorded. The strips were individually fed into a Kamas laboratory hammermill, Kamas Industries AB Type KVARN H 01, for disintegration. The hammermill was a screened hammermill with screen size of 16–17 mm. The hammers were run at 3000 rpm and the feed rate was 8 ft/min. The power consumption required for disintegration was measured.

Procedure for Preparation of Specimens for Testing Absorbent Capacity, Strength, and Fluid Transport Properties of Airfelts The cellulose fibers used in the test airfelt pads were provided as either treated with a debonding agent or untreated machine sheeted cellulose pulp obtained from the Buckeye Cellulose Corporation. The dry, machine sheeted pulp was converted into an airfelt which did not contain a large quantity of fiber clumps by cutting the pulp into 1"×4" strips with the 4" dimension in the machine direction. The strips were individually fed into a laboratory fluffer at a consistent rate of about 1 strip every four seconds to produce a uniform fluff.

A laboratory scale padmaker which duplicates the commercial padforming process was used to air lay the dry uniform fluff into airfelt pads in a conditioned environment. In order to overcome the effects of disintegrating the comminution pulp in an unconditioned atmosphere and expose the pads to the conditioned environment, the pads were allowed to remain in the padmaker for 4–5 minutes while conditioned air is pulled through the pad. Additionally, this procedure overcomes the possible effect of the compressed air used in padmaking not being at 50% relative humidity.

A ply of tissue which measured 14-½"×14-½" was placed on the forming screen of the padmaker. The tissue completely covered the forming screen and curved up the sides. This tissue represents the bottom side of the airlaid airfelt pad. An appropriate amount of the fluff sample was added to the padformer in four equal increments to form a uniform pad. After the fluff was added to the airlaid airfelt pad, the forming screen was removed with the airfelt pad on it and carefully transferred to a smooth, flat surface. A second covering tissue was marked to indicate the top side of the airlaid airfelt pad and placed on top of the pad, making sure that the machine direction of the second tissue ply is in the same direction as that of the first ply. A weight which measured 14"×14" was placed on the pad in a manner which did not disturb the formation of the airfelt pad. The weight was allowed to remain on the airfelt pad for a minimum of 5 minutes and then carefully removed.

The pad was cut into a 12-¾"×12-¾" square by removing approximately the same from each edge with a standard paper cutter board. This pad was cut into nine square pads which measured 4-¼"×4-¼" each. The airlaid felt pads were then stored in an area maintained at 23±1° C. (73.4±2° F.) and 50±5% relative humidity until needed for testing.

The covering tissues on the 4-¼"×4-¼" pad were carefully removed and the pad was placed on the bottom half of an aluminum press plate. The press plate is made from two blocks of aluminum measuring 6"×6"×1". One 6"×6" face of each block was machined to a perfectly flat surface. Aligning pins are fixed near two comers of one plate. Corresponding holes are formed in the other plate for receiving the pins. The top half of the press plate was placed over the pad to pressed and the entire press plate was placed on a Carver hydraulic press (Model No. 16600-224). Each pad was pressed at the appropriate pressure to produce the desired density. Since the size of the pad increased as a result of pressing, the pad was trimmed to measure 4"×4" each and weighed. After waiting 120 seconds for delayed rebounding, the thickness of each pad was measured. The density of the pad was then calculated according to the following formula:

$$\text{Density in grams/cc of } 4'' \times 4'' \text{ pad} = \frac{0.000379 \times \text{weight (gms)}}{\text{thickness (inches)}}$$

Procedure For Drip Capacity Test

In order to demonstrate the fluid transport capability of an absorbent structure made from cellulose fibers treated with a debonding agent according to the present invention, airfelt pads which contained 100% debonded cellulose fibers were prepared according to the procedure described above. The fluid transport capability of each airfelt pad was measured by determining the drip capacity in milliliters of liquid per grams of cellulose in an airfelt pad without covering tissues.

Synthetic urine was prepared by dissolving 108.4 g of a dry synthetic urine mixture in 20 liters of distilled water. The dry synthetic urine mixture may be obtained from Endovations, Inc., Reading, Pa. A burette was filled with the synthetic urine solution and the flow rate of the pipette was adjusted to deliver 2 mls of urine per second.

Synthetic menses was prepared by dissolving 6.1 g of NaCl, 2.3 g of $NaHCO_3$, 0.3 g of $CaCl_2$, 65 g of albumin, 13 g of carboxymethyl cellulose, and 4 g of 10% antispumin solution in 903 g of deionized water. The pH was adjusted to 7.4 with either HCl or NaOH. A burette was filled with the synthetic menses and the flow rate was adjusted to deliver 2 ml of fluid per second.

The delivery tip on the stopcock of the burette was positioned 1" above and perpendicular to a cube made of 0.5 inch wire mesh. The cube was placed in a pan for receiving the excess fluid. The top face of the cube was maintained in a level position.

Immediately after pressing to the desired density, the pad was placed on the cube so that the fluid impact point is at a crosswire position. Simultaneously, the stopcock on the burette was opened and the timer was started. The test fluid (either synthetic urine or synthetic menses) was allowed to drip at a controlled rate onto the center of the pad. The timer was stopped when the first drop of liquid was released by the pad and fell into the pan. The time required for the first drop of liquid to pass through the pad was recorded.

The wet pad was removed from the cube and discarded. The cube was dried completely and returned to the pan. The above procedure was repeated on two more airfelt pads which were identical to the first in weight, density and composition. The weight, density, and time was recorded for each of the three individual pads. The drip capacity for each pad was calculated according to the following formula:

$$\text{Drip capacity in milliliters liquid/gram sample} = \frac{\text{Time in sec.} \times 2}{\text{Weight (grams) of } 4'' \times 4'' \text{ pad}}$$

The average drip capacity of the three pads was then determined.

Procedure For Total Absorptive Capacity

In order to demonstrate the absorptive capability of an absorbent structure made from the cellulose fibers treated with a debonding agent according to the present invention, airfelt pads were prepared according to the procedure described above. The absorptive capacity was measured on airfelt pads without the covering tissue.

A 4"×4" airfelt pad at the appropriate basis weight and density was placed on a tared, plexiglass plate and weighed. The pad and plexiglass plate are placed on a 60 degree inclined platform. The pad is saturated with either synthetic urine or synthetic menses. The excess liquid is allowed to drain away and removed with blotters. The plexiglass plate and saturated pad are weighed. The total absorbent capacity is calculated as:

$$\text{Absorptive capacity (g/g)} = \frac{\text{wet weight} - \text{dry weight}}{\text{dry weight}}$$

Procedure For Burst Strength Test

In order to demonstrate the burst strength of an absorbent structure formed from the cellulose fibers treated with a debonding agent according to the present invention, airlaid airfelt pads were prepared according to the method of the present invention. Airfelt pads which contained either debonded cellulose fibers or untreated cellulose fibers were prepared according to the procedure described above for use as control pads. The burst strength of each pad was determined by measuring the force required for the ball penetrator of a conventional tensile testing apparatus to reach the point of no resistance in a pad without covering tissues.

A Thwing Albert Intelect II tensile tester was used to measure the burst strength of the airfelt pads. The tensile tester includes a clamp platform and clamp plate for securing a test pad in a horizontal position between the platform and the plate. The platform and clamp plate are provided with corresponding holes for receiving a ball penetrator which is positioned directly above the holes. The tensile tester was set up in compression mode and attached to a gram cell which monitors any resistance encountered by the ball penetrator. The ball penetrator had a diameter of 1.5 cm.

Immediately after pressing to the desired density, the pad was placed over the hole on the clamp platform, and the clamp plate was securely clamped over the pad to hold the pad in place. The Intelect was started, with the crosshead set to travel downward at 0.5 in/min or 1.27 cm/min. As the ball penetrator moves down and contacts the pad, an ever increasing force measurement shows continuously on the monitor. The penetrator continues to move completely through the pad until reaching the point of no resistance, which is typically when the pad breaks. At this point, the crosshead automatically rebounds upward to the starting position. The maximum force value on the monitor of the Intelect was recorded. This process was repeated two times with new airfelt pads. Three pad values were averaged and the maximum force value was reported in grams.

EXPERIMENTAL EXAMPLE 1

Pulp samples debonded with alum according to the method of the present invention were compared to standard comminution pulp from Buckeye Cellulose Corporation for disintegration energy using the procedures outlined above. The results are summarized in the following Table 1:

TABLE 1

| | Disintegration Energy (KWH/ton) |
|---|---|
| Standard Comminution Pulp | 18.5 |
| Alum Softened Pulp | 10.5 |

EXPERIMENTAL EXAMPLE 2

Airfelt pads made from alum treated fibers were prepared and tested for absorbency, fluid transport properties, and airfelt strength using the procedures described above. The results are summarized in the following Table 2:

TABLE 2

| | Basis Weight (g/in2) | Density (g/cc) | Test Fluid | 2 ml Drip Capacity (g/g) | Total Absorptive Capacity (g/g) | Airfelt Strength (g) |
|---|---|---|---|---|---|---|
| Standard Comminution Pulp | 0.2 | 0.2 | urine | 3.23 | 11.5 | 162.1 |
| Alum Softened Comminution Pulp | 0.2 | 0.2 | urine | 3.48 | 11.5 | 165.4 |
| Standard Comminution Pulp | 0.6 | 0.07 | menses | 5.9 | 14.7 | 109.4 |
| Alum Softened Comminution Pulp | 0.6 | 0.07 | menses | 5.7 | 15.0 | 116.3 |

EXPERIMENTAL EXAMPLE 3

The effect of surfactant addition was tested on laboratory handsheets. Handsheets were prepared by disintegrating 55 g of standard sheeted comminution pulp from the Buckeye Cellulose Corporation in 2 liters of water in a TAPPI disintegrator. The resultant slurry was poured into the headbox of a Williams landsheet mold fitted with a 9.5 in×11.5 in, 80 mesh screen. The slurry was diluted in the headbox to 0.8% pulp consistency with water and agitated to obtain a uniform mixture. The water was drained at a rate of 1.7 liters/sec to form a fiber web on the screen. The web was couched off of the screen, pressed to 50% moisture, then dried to 9% moisture on a heated drum dryer. The resulting handsheets were allowed to condition at 70° F. and 50% RH for at least 2 hours prior to testing. The handsheets had a density of 0.6–0.7 g/cc and basis weights of 0.51–0.53 g/in$^2$.

The surfactant treated sample was prepared by disintegrating 55 g of standard sheeted comminution pulp from the Buckeye Cellulose Corporation in 2 liters of water in a TAPPI disintegrator. The resultant slurry was poured into a headbox of a Williams handsheet mold fitted with a 9.5 in×11.5 in, 80 mesh screen. The slurry was diluted in the headbox to 0.8% consistency with water. To this mixture 0.1 g of Berol 579 surfactant was added. The slurry was agitated for 2 minutes to obtain a uniform mixture. The water was drained at a rate of 1.7 liters/sec to form a fiber web on the screen. The web was couched off of the screen, pressed to 50% moisture, then dried to 0% moisture on a heated drum dryer. The resulting handsheets were allowed to condition at 70° F. and 50% RH for at least 2 hours prior to testing. The handsheets had a density of 0.6–0.7 g/cc and basis weights of 0.51–0.53 g/in$^2$. The handsheets were converted to airfelt pads by the methods described above.

The disintegration properties, absorbency properties, and airfelt strength of these airfelt pads were measured by the methods described above and the results are summarized in the following Table 3 and Table 4.

TABLE 3

| | Disintegration Energy (KWH/ton) |
|---|---|
| Standard Comminution Pulp | 14.2 |
| Surfactant Treated Pulp | 5.7 |

TABLE 4

| | Basis Weight (g/in2) | Density (g/cc) | Test Fluid | 2 ml Drip Capacity (g/g) | Total Absorptive Capacity (g/g) | Airfelt Strength (g) |
|---|---|---|---|---|---|---|
| Standard Comminution Pulp | 0.2 | 0.2 | urine | 3.22 | 10.50 | 218.7 |
| Surfactant Treated Pulp | 0.2 | 0.2 | urine | 1.76 | 10.77 | 143.2 |

EXPERIMENTAL EXAMPLE 4

In Experimental Example 4, the effectiveness of Kaolin clay as a debonding agent was demonstrated by comparing two samples of Kaolin coated fibers and a control sample without Kaolin clay. An aqueous slurry of cellulose fibers was prepared by conventional techniques. Approximately 55 gms bone dry pulp, 0.25 gms polyacrylamide, and Kaolin clay in amounts of 8% and 20%, respectively, based on the bone dry pulp were added to a TAPPI disintegrator. Water was added to each slurry according to the instructions for the TAPPI disintegrator. The pH was determined, but not adjusted. Each slurry was disintegrated for 2 min. and then poured into a William's handsheet mold. Each slurry was then made into 50 gm handsheets using the procedure described above.

The hand sheets containing 8% and 20% Kaolin clay, respectively, and a Foley Fluff control hand sheet were tested for ash content per TAPPI test T-211 to confirm that the Kaolin clay had deposited on the fibers and, therefore, was responsible for any observed affects. The ash content for the samples is shown in Table 5.

TABLE 5

| Sample | Ash, % |
|---|---|
| Control (Foley Fluff) | 0.17 |
| 8% Kaolin | 1.40 |
| 20% Kaolin | 3.55 |

Pulp sheets made from the Kaolin treated fibers were evaluated and compared with conventional untreated fibers using the procedures stated above in "Procedure for Measuring Disintegration Energy" to assess the disintegration energy required to fiberize the sheet. The results are summarized in Table 6:

TABLE 6

Disintegration Energy Reduction and Airfelt Properties

| | Basis Weight ($g/in^2$) | Density (g/cc) | Kamas Mill Energy (kwh/ton) |
|---|---|---|---|
| Standard Comminution Pulp | 0.55 | 0.70 | 16.6 |
| 8% Kaolin Treated Pulp | 0.54 | 0.71 | 14.3 |
| 20% Kaolin Treated Pulp | 0.55 | 0.70 | 11.7 |

The treated sheets were then disintegrated and formed into airfelts as described above in the "Procedure for Preparation of Specimens for Testing Absorbent Capacity, Strength, and Fluid Transport of Airfelts". The airfelts were then tested in accordance with the test procedures described in the above-mentioned section, using synthetic urine as the test fluid. The results are summarized in Table 7.

TABLE 7

Comminution Properties Measured on Airfelts Properties

| | 2 ml Drip Capacity (g/g) | Total Absorptive Capacity (g/g) | Airfelt Strength (g) |
|---|---|---|---|
| Standard Comminution Pulp | 2.85 | 11.90 | 108.1 |
| 8% Kaolin Treated Pulp | 2.34 | 11.0 | 117.8 |
| 20% Kaolin Treated Pulp | 2.06 | 11.7 | 110.5 |

Although the invention is described with respect to preferred embodiments, it is expected that various modifications may be made thereto without departing from the spirit and scope of the invention.

What is claimed is:

1. A method of reducing the energy required to disintegrate a comminution sheet formed from cellulose fibers without substantially reducing the absorbency, strength or fluid transport properties of airfelts formed from the comminuted fibers, said method consisting essentially of the steps of:

forming an aqueous slurry of cellulose fibers;

adding a debonding agent to said cellulose slurry to coat the fibers in said slurry wherein the debonding agent is selected from the group consisting of alum, Kaolin clay, calcium carbonate, titanium dioxide and zinc oxide, said debonding agent being added in an amount effective to reduce the energy required to disintegrate a comminution sheet formed from said coated fibers by about 15% to about 50% from the amount of energy required to disintegrate comminution sheets formed from uncoated fibers; and forming said coated fibers into a comminution sheet.

2. The method of claim 1 wherein said aqueous cellulose slurry has a consistency of between about 1% and about 5%.

3. The method of claim 1, wherein the debonding agent is Kaolin clay.

4. The method of claim 1, wherein the debonding agent is alum.

5. The method of claim 1, wherein the amount of debonding agent deposited on the fibers is between 5 and 15 pounds per ton of pulp fibers.

6. The method of claim 4, wherein the amount of aluminum precipitate on the fibers is between 2500 ppm and 6000 ppm.

7. The method of claim 1, wherein the pH of the slurry is adjusted to between 4.0 and 8.0 after the addition of said debonding agent.

8. The method of claim 7, wherein the pH of the slurry is adjusted to between 5.0 and 5.5 after the addition of said debonding agent.

* * * * *

UNITED STATES PATENT AND TRADEMARK OFFICE

CERTIFICATE OF CORRECTION

PATENT NO. : 6,159,335

DATED : December 12, 2000

INVENTOR(S) : James William OWENS et al.

It is certified that errors appear in the above-identified patent and that said Letters Patent is hereby corrected as shown below:

Foremost Page [75], change the 4th inventor to read as follows:

- - JOHN J. RYAN, DECEASED, LATE OF MEMPHIS, TENN., BY RUTH RYAN, ADMINISTRATRIX OR EXECUTRIX ON HIS BEHALF- -.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,159,335
DATED : December 12, 2000
INVENTOR(S) : James W. Owens et al.

It is certified that error appears in the above-identified patent and that said Letters Patent is hereby corrected as shown below:

Title page,
Please insert the following:
-- [60] Related U.S. Application Data
Provisional application No. 60/038,245 filed February 21, 1997. --

Column 1,
Line 3, please insert the following paragraph under the title:

-- This application is based upon Provisional Patent Application Serial No. 60/038,245 filed February 21, 1997. Applicants claim the benefit of the filing data of the aforesaid provisional application under U.S.C. §119. --

Signed and Sealed this

Second Day of March, 2004

JON W. DUDAS
*Acting Director of the United States Patent and Trademark Office*